United States Patent [19]

Rood

[11] Patent Number: 4,645,696

[45] Date of Patent: Feb. 24, 1987

[54] TREATMENT FOR IMPROVING CELLULOSIC INSULATION

[76] Inventor: Leonard D. Rood, 5764 Flintlock La., Columbus, Ohio 43213

[21] Appl. No.: 810,565

[22] Filed: Dec. 6, 1985

Related U.S. Application Data

[63] Continuation of Ser. No. 474,790, Mar. 14, 1983, abandoned, which is a continuation-in-part of Ser. No. 412,318, Aug. 27, 1982, abandoned, which is a continuation of Ser. No. 265,029, May 18, 1981, abandoned.

[51] Int. Cl.[4] ..... A62C 1/00; A62D 1/00; B27N 9/00

[52] U.S. Cl. ..... 428/35; 252/2; 252/3; 252/5; 252/7; 252/62; 252/500; 252/607; 428/921

[58] Field of Search ..... 252/500, 607, 2, 3, 252/5, 7, 62; 428/921, 35

[56] References Cited

U.S. PATENT DOCUMENTS 3,944,702 3/1976 Clark ..... 428/391 X
4,182,681 1/1980 Gumbert ..... 252/62 X
4,184,311 1/1980 Rood ..... 428/35
4,386,119 5/1983 Draganov ..... 252/62 X
4,430,380 2/1984 Honel et al. ..... 428/288 X

OTHER PUBLICATIONS

McCutcheon's Functional Materials, The Manufacturer's Confectioner Publishing Co., 1980 Annual, pp. 24–28.

*Primary Examiner*—John E. Kittle
*Assistant Examiner*—Mukund J. Sham
*Attorney, Agent, or Firm*—Frank H. Foster

[57] ABSTRACT

In connection with the manufacture of cellulosic insulation of the type utilizing shredded newspaper which is treated with a fire retardant chemical composition and used for the thermal insulation of building structures, an anti-static agent is mixed and adhered to the fire retardant agent prior to depositing the fire retardant agent on the shredded cellulosic material. The anti-static agent may also be introduced into the finished product with desirable but not as significant improvements in the insulation and its manufacture.

16 Claims, No Drawings

TREATMENT FOR IMPROVING CELLULOSIC INSULATION

This is a continuation of application Ser. No. 474,790, filed 3-14-83, now abandoned, which is a continuation-in-part of my co-pending application Ser. No. 412,318, filed Aug. 27, 1982, now abandoned which is a continuation of application Ser. No. 265,029 filed May 18, 1981, now abandoned.

TECHNICAL FIELD

This invention relates generally to cellulosic insulation of the type utilizing a shredded newspaper base which is treated with a fire retardant chemical composition and used for the thermal insulation of homes and other building structures. More particularly, the invention relates to the addition of a chemical agent which results in numerous and remarkably varied improvements in the characteristics of the finished product as well as improvements which aid in the manufacturing operations.

BACKGROUND ART

The manufacture of cellulosic insulation in accordance with the present state of the art begins with a grinding operation in which newspapers are shredded to provide a mass of cellulosic fibers.

A fire retardant composition is then mixed with the cellulosic fibers in order to coat them with the fire retardant material. This mixing is conventionally accomplished in one of two manners.

The fire retardant may be dissolved in a suitable solvent such as water and then sprayed into a stirred mass of the shredded cellulosic material. The spray application of the retardant may be performed simultaneously with a grinding step for shredding the cellulosic material or as a subsequent step.

One of the major disadvantages of the solution spray application system is that the resultant mixture becomes a sticky, gummy mess which is difficult to handle and requires drying.

Alternatively fire retardant may be applied in dry, powdered form which may be mixed with stirred cellulosic fibers during a grinding operation or an independent stirring operation. However, difficulty is experienced in effecting the adhesion of the fire retardant particles to the cellulosic shredded material with a sufficiently durable bond. It also has been difficult or impossible to obtain a complete and uniform coating of fire retardant on the cellulosic particles.

These latter problems have, in the current state of the art, been reduced somewhat by spraying small quantities of water on the cellulosic material before mixing in the fire retardant in order that the dry fire retardant particles will be wetted when they come into random contact with the cellulosic fibers. Thus, the cellulosic fibers are adhered to the cellulosic fibers by the wetting activity of the moisture.

However, even this system has several disadvantages including the still somewhat agglomerated or clumpy nature of the finished product, the non-uniform and incomplete coating of the fibers and the need for drying the insulation after the retardant is applied.

BRIEF DISCLOSURE OF THE INVENTION

In summary, the present invention contemplates the mixing of an anti-static agent with the fire retardant agent prior to depositing the fire retardant agent on the cellulosic insulation material. Contrary to the prior art, with the use of the anti-static agent it is preferred that the shredded cellulosic material be dry and therefore the manufacturing operation preferably does not include a wetting operation before the fire retardant is applied to the cellulosic fibers.

The simple addition of an anti-static agent has resulted in an extensive array of improved characteristics for the cellulosic insulation. For example, the fire retardant agent is coated more uniformly and more completely over the entire surface of the cellulosic insulation fibers. Additionally, because the coating is more complete, more uniform and thinner, less fire retardant agent is required to adequately treat the cellulosic shredded insulation.

Furthermore, it has been found that the resulting finished product is a cellulosic insulation which is more homogeneously loose and fluffy and does not exhibit undesirable knots or clumps of tightly agglomerated materials. As a result it is easier to package it in bags, it is easier to blow it into a structure and it provides greater thermal resistance and increased production capacity.

Additionally, the preferred anti-static agents are hygroscopic and therefore retain water even at low humidity. This retained water improves the fire retardant characteristic of the insulation.

The dust usually generated during the application of a powdered fire retardant to the shredded cellulose is very substantially reduced by the present invention thereby enhancing the manufacturing environment and the cleanliness of the equipment.

DETAILED DESCRIPTION FOR CARRYING OUT THE INVENTION

While attempting to find a means for reducing the dust generated during the manufacture of shredded cellulosic insulation, an anti-static agent was sprayed upon the shredded cellulosic insulation. It was eventually discovered that all the above advantages could be gained by mixing and effecting the adhesion of an anti-static agent with the fire retardant agent prior to depositing the fire retardant agent on the shredded cellulosic material. After the anti-static agent and the fire retardant agent are mixed they are together mixed with and deposited upon the shredded cellulosic material.

The anti-static agent may be added, mixed or blended with a particulate fire retardant agent either by mixing or spraying a liquid solution of the anti-static agent onto the particulate fire retardant agent or by blending a particulate anti-static agent with the particulate fire retardant agent.

Preferably the shredded cellulosic material is substantially unwetted at the time it is mixed with the mixture of anti-static agent and fire retardant agent. It has been found that the dry shredded cellulosic material accomplishes better coating of the cellulosic fibers with the fire retardant agent than is accomplished if the cellulosic fibers are prewetted as done in the prior art.

The anti-static agent constituent of the mixture of anti-static agent and the retardant agent is preferably on the order of 0.1% to 1% by weight in a system in which the finished product is loaded with 20% retardant. The important proportion is believed to be the proportion of anti-static agent used in the finished insulation product. Preferably the finished product is 0.02% to 0.2% by weight of anti-static agent. Less than this minimum amount may be insufficiently effective and more than the maximum amount does not seem to provide sufficiently improved results to justify the cost of the use of the additional material. However, it should be understood that quantities outside this range can be useful.

There are various types of anti-static agents described in the prior art. It has been found that one effective class of agents which is effective in the present invention are the quaternary ammonium compounds. These are the preferred anti-static agents.

Upon observing the improved characteristics described above an attempt was made to study them and formulate a theory explaining these phenomena. The following is the inventor's theory of the operation of the invention.

It is hypothesized that during the shredding of the cellulosic material, the shredding operation causes a generally high negative electrostatic charge to accumulate on the surface of the cellulosic fibers. Although the mass of fibers is generally negative, the rubbing of some fibers against other fibers will cause some fibers to be relatively more negative and others to be relatively more positive than the overall average negative static charge on the entire mass.

The mixture of a dry, powdered fire retardant with the shredded cellulosic material does not accomplish adequate coating of the fire retardant on the cellulosic material and the reason is believed to be the existence of electrostatic repelling forces between those materials. However, when the workers in the prior art sprayed water upon the cellulosic shredded fibers two phenomena are believed to have occurred. First, the electrostatic charge was removed by conduction through the moisture layer on the fibers thereby reducing the repelling forces. Secondly, the presence of moisture on the fibers wetted any particulate fire retardant which contacted them to adhere them by wetting.

The addition of an anti-static agent to the fire retardant agent in accordance with the present invention, especially when coupled with non-wetting of the cellulosic fiber entirely changes the mode of coating and the electrostatics of the system.

An anti-static agent is a type of material recognized in the art. It is added to another material to reduce the propensity of the other material to accumulate charge and to aid in the discharging of localized charges which might accumulate on the other material.

Most anti-static agents increase the conductance at the surface of the material being treated. Of these, most are hygroscopic in order to form a surface layer of moisture. Frequently the anti-static agent is also an electrolyte which improves the conductance of the moisture layer.

Anti-static agents have been used in the textile industry to prevent the attraction of fiber particles to various parts of the spinning machinery to which they otherwise were attracted and interferred with processing. They have also been applied to garments to prevent so-called static cling. Additionally, they have been applied to various objects such as chemical containers and phonograph records to prevent the buildup of dirt and dust on such objects.

A variety of materials has been identified and others may be identified in the future which exhibit anti-static properties. To be useful as an anti-static agent a material must retain its anti-static properties at low humidity and must be sufficiently durable that aging and mechanical actions such as friction do not quickly destroy the anti-static properties.

Many materials have been identified in the art as anti-static agents and these include variations of cross linked polyamines containing polyethoxy segments, Dialkyldimethyl ammonium salts, Alkylbenzyldimethyl ammonium chlorides and Alkyltriethyl ammonium salts. The materials I prefer are Dimethyldistearyl ammonium chloride and Dimethylditallow ammonium chloride.

Thus, generally an anti-static agent is a surfactant which is sufficiently hygroscopic to form a solution with water in equilibrium with the ambient atmosphere. The anti-static agent must have a sufficiently low vapor pressure that it will not be lost by evaporation. Some literature states that an anti-static agent should be in equilibrium with an atmosphere having a relative humidity of as low as 25% and preferably, they supply ions for electrolyte activity.

Therefore, it is believed that the addition of the anti-static agent to the fire retardant agent leaves the fire retardant agent substantially uncharged, that is electrostatically neutral.

The negatively charged cellulosic fibers are preferably manufactured to maximize their electrostatic charge.

Therefore, it is believed that when the fire retardant agent which has been treated with the anti-static agent is mixed with the cellulosic fibers, the fire retardant agent particles are attracted to all the cellulosic fibers by dielectrophoresis.

Electrophoresis describes the motion of a charged particle in an electric field which is either uniform or non-uniform. Dielectrophoresis relates to the motion of neutral matter in a non-uniform electric field. Neutral matter in a uniform electric field has no motion.

In an electric field, a neutral body is polarized and forms a dipole. In a uniform electric field, each pole of the polarized dipole sees the same field intensity and therefore it has no net force applied to it. However, in a non-uniform electric field each pole sees a different field intensity. The field diverges across the particle. Each pole therefore has a different force exerted upon it. There is therefore a net force upon the neutral particle so it is translated. The result is a dielectrophoretic force which causes the body to be attracted to the region of highest electric field intensity regardless of whether it is a negative or a positive charge.

It is therefore believed that the thin, uniform nature of the coating of fire retardant agent over all cellulosic particles is accomplished in the present invention because the particles are attracted by dielectrophoretic forces. Thus, the mixing of treated fire retardant agent with the cellulosic fibers results not only in coating on the most negatively charged fibers, but also results in coating on those fibers which are less negatively charged than the average of the entire mass of particles and which are therefore positive with respect to the more negatively charged particles.

Additionally, difficulty in coating in the past has been greatest at the extreme points and tips of the fibers particles. However, because electric fields tend to be greater in the region of points, fire retardant agent is attracted to these sharp points. Therefore, the present invention improves coating at these points and tips. It is also theorized that as surface areas of the cellulosic fibers become coated with the surfactant-treated fire retardant agent the coated areas become somewhat shielded and the uncoated regions are then areas of higher electric field and therefore have greater attraction to remaining fire retardant particles. Consequently, the fire retardant particles are attracted to the uncoated areas and the coating tends to be more uniform than in the prior art systems where deposition is random. This also results in a need for less fire retardant agent.

It has been found for example that where in the past a proportion of 22% of the fire retardant constituent was needed in the entire finished insulation product, that requirement has been reduced to 16–20%.

The quantity of dust generated during manufacturing operations is greatly reduced. The most minute particles of fire retardant agent and the most minute particles of cellulosic fiber are the ones which tend to be lost in the atmosphere as dust. It is believed that in the past these particles, because of their negative charge, were so significantly repelled that they would not coagulate or settle. However, treatment with the anti-static agent is believed to cause these particles to coagulate into larger particles which can then settle in the finished insulation rather than being dispersed in the atmosphere as dust particles.

Further, it has been observed that finished cellulosic insulation which is not treated in accordance with the present invention tends to form clumps of relatively dense areas of matter. It is theorized that these are formed because some of the cellulosic particles become charged to a different degree than other particles because of the rubbing of cellulosic particles against other particles. These, it is believed, are electrostatically attracted to form the clumps.

It has been observed that cellulosic insulation which has been treated in accordance with the present invention is relatively free of these clumps. It is a more uniform, relaxed and loose product. It is theorized that this occurs because after the fire retardant agent treated in accordance with the present invention is coated upon the cellulosic fibers, the anti-static activity then operates to discharge the cellulosic coated fibers so that they are relatively neutral with respect to each other and therefore forces of attraction forming clumps have been removed. There is therefore some advantage to be gained by applying the anti-static agent to the finished insulation.

This removal of repelling electrostatic charges from the finished product makes it much easier to compact the processed cellulosic insulation into containers such as paper sacks.

Because the preferred anti-static agents are selected to be those which are hygroscopic and consequently have a high affinity for water to form the electrically conductive surface layer, the presence of the water also improves the resistance of the finished insulation product to fire because the additional moisture aids in the dousing of any fire introduced into the insulation. This characteristic is particularly significant in the low humidity ambient environment often found in attics or other areas of building structures which are exposed to high heat especially in the summer season.

The invention can be illustrated further by the following examples, but it is understood that the invention is not meant to be limited to the details disclosed therein. In the examples, all parts and percentages are by weight unless otherwise noted.

Table I contains a list of examples and includes a burn evaluation column which is a good approximate measure of the fire retardant effectiveness.

This test was conducted on a basis wherein a four inch diameter by one inch deep aluminum pan was filled with a specimen of insulating material treated in accordance with the present invention. The sample was then heated by a 250 watt infra red bulb with the bulb face disposed approximately 10 inches above the bottom of the pan. After a period of three minutes, the specimen was ignited using a conventional paper book match. After an appropriate short period, the length and width of the burn area was measured in inches.

The insulation material in these examples was prepared in the manner described below.

The chemical retardant, in dry powder form, was placed in a ball mill and ground to a particle size no greater than approximately 150 mesh. Then a dry anti-static agent was mixed with a pre-determined amount of fire retardant chemical using a mortar and pestle until a uniform mixture was assured.

A pre-determined amount of shredded paper was placed in a blender with a pre-determined amount of the dry mixture of the fire retardant and anti-static agents. This combination was agitated in the blender for a 2 to 3 second time period. Then enough of the treated paper was removed from the blender to fill an aluminum pan as previously described to conduct the burn test.

The following tables illustrate the proportion of the anti-static agent to the fire retardant agent used in each example, the specific agents used, and the burn results.

In each example, the same amount of fire retardant chemical by weight as a percent of the untreated cellulosic material was used and pre-selected as eighteen percent.

The eighteen percent loading of the fire retardant agent was selected to provide a measure of the effectiveness of the varying percentages of the anti-static agent employed. It should be recognized that a higher loading of fire retardant agent such as twenty to twenty-three percent may give even better burn retardant results, however, the results listed indicate the increase in effectiveness of the fire retardant agent when relatively small amounts of anti-static agent are employed with a given amount of each fire retardant agent.

Also it should be pointed out that the results of retarding the burn area vary as a function of the specific fire retardant agent used. Some fire retardant agents or mixtures thereof are more effective than others. This is also true regarding certain specific anti-static agents.

Therefore, the specific choice of the agents used and their relative proportions are a function of the degree of effectiveness required and the cost as related to commercially practical results. However, the addition of an anti-static agent significantly improved the effectiveness of the fire retardant agent. Therefore a significant saving in the amount of fire retardant agent can be realized in accordance with the present invention as well as other advantages as noted earlier herein.

TABLE I

| Example # | Fire Retardant | Anti-Static Agent | Anti-Static Agent as a % of fire retardant | Burn Dimensions |
|---|---|---|---|---|
| 1 | Ammonium Sulfate | — | 0 | 3" × 4" |

TABLE I-continued

| Example # | Fire Retardant | Anti-Static Agent | Anti-Static Agent as a % of fire retardant | Burn Dimensions |
|---|---|---|---|---|
| 2 | " | DiStearyl dimethyl ammonium chloride | 0.5 | 2" × 3" |
| 3 | " | DiStearyl dimethyl ammonium chloride | 1.0 | 1½" × 1½" |
| 4 | " | DiStearyl dimethyl ammonium chloride | 2.0 | 1" × 1½" |
| 5 | " | DiStearyl dimethyl ammonium chloride | 5.0 | 1½" × 1½" |
| 6 | " | DiStearyl dimethyl ammonium chloride | 10.0 | 2" × 3" |
| 7 | 3 parts Ammonium Sulfate 2 parts Borax 1 part Boric Acid | — | 0 | 4" × 4" |
| 8 | 3 parts Ammonium Sulfate 2 parts Borax 1 part Boric Acid | DiStearyl dimethyl ammonium chloride | 2.0 | 2" × 3" |
| 9 | Diammonium Phosphate | — | 0 | 4" × 3" |
| 10 | Diammonium Phosphate | DiStearyl dimethyl ammonium chloride | 1.0 | 2" × 3" |
| 11 | Diammonium Phosphate | DiStearyl dimethyl ammonium chloride | 2.0 | 2" × 2½" |
| 12 | 1 part Diammonium phosphate 1 part Ammonium Sulfate | 0 | 0 | 4" × 4" |
| 13 | 1 part Diammonium phosphate 1 part Ammonium Sulfate | DiStearyl dimethyl ammonium chloride | 1.0 | 3" × 3" |
| 14 | 1 part Diammonium phosphate 1 part Ammonium Sulfate | DiStearyl dimethyl ammonium chloride | 2.0 | 2" × 3" |
| 15 | 1 part Diammonium phosphate 1 part Ammonium Sulfate | DiStearyl dimethyl ammonium chloride | 5.0 | 3" × 3" |
| 16 | 1 part Diammonium phosphate 1 part Ammonium Sulfate | Polyoxethlene tallow amine | 1.0 | 1" × 2" |
| 17 | 1 part Diammonium phosphate 1 part Ammonium Sulfate | Methyl-1-tallow amido ethyl-2-tallow imidizlinium methyl sulfate | 1.0 | 2" × 3" |
| 18 | 1 part Diammonium phosphate 1 part Ammonium Sulfate | dialkyl ($C_{12}$–$C_{18}$) dimethyl ammonium chloride | 1.0 | 2" × 3" |
| 19 | 1 part Diammonium phosphate 1 part Ammonium Sulfate | dihydrogenated tallow dimethyl ammonium chloride | 1.0 | 3" × 3" |

It can be readily observed that the examples listed in Table I show that a relatively small percentage of anti-static agent added to the fire retardant agents increased the fire retardant effectiveness of each agent compared to the tests results when no anti-static agent was used.

In addition, a comparison of the examples show that the amount of anti-static agent beyond a certain amount, such as approximately 2 percent based upon the weight of the fire retardant agent, does not appear to proportionally increase the fire retardant effectiveness. This indication appears to coincide with the theory that once the available fire retardant agent coats the available insulation material, additional anti-static agent does not significantly increase burn retardant effectiveness. It also tends to show that the anti-static agent does not significantly function as a fire retardant agent as such, but merely aids in the more uniform distribution and adherence of the fire retardant agent to the shredded insulation.

It is also important to point out that the increase in effectiveness obtained by employing a relatively very small amount of anti-static agent is very important in the insulation industry. The industry is very price competitive and a savings of even 2 or 3 percent of the fire retardant chemical required to achieve government standards of effectiveness is a very important and significant factor in such a business. Also, this increase in effectiveness as noted herein permits a manufacturer greater latitude in choosing a given fire retardant chemical depending upon the current availability and price of these chemicals and still meet the necessary government standards.

A preferred formulation of fire retardant and anti-static agent which has been found to achieve excellent results in accordance with the present invention consists of a mixture comprising 65 percent of Ammonium Sulfate, 30 percent of Di-ammonium Phosphate, 4 percent of Triple Super Phosphate, and 1 percent of Di-stearyl Dimethyl Ammonium Chloride. The above percentages are by weight and this mixture is made up and blended with the shredded cellulosic material as previously described herein.

This mixture of the fire retardant agent and anti-static agent has been found to provide an effectiveness rating qualifying under present official standards when employed in amounts of approximately 16 to 18 percent based upon the total weight of the finished product. However, it is believed that this amount can be significantly lowered when more efficient and sophisticated mixing and blending equipment is employed in larger commercial applications and still meet present official standards of fire-retardant effectiveness ratings.

I claim:

1. An improved cellulosic insulation comprising:

(a) shredded cellulosic fibers; and (b) a mixture of an inorganic fire retardant agent and an anti-static agent, said mixture being a solid particulate and adhered on said fibers.

2. An insulation in accordance with claim 1 wherein said anti-static agent is a quaternary ammonium compound.

3. An insulation in accordance with claim 1 wherein said insulation comprises substantially 0.02% to 0.2% by weight of said anti-static agent.

4. An improved method for manufacturing fire retardant cellulosic insulation of the type comprising shredded cellulosic fibers having an inorganic fire retardant agent deposited on it wherein the improvement comprises: mixing an anti-static agent with the fire retardant agent to form a solid particulate prior to depositing the fire retardant agent on the shredded cellulosic material and subsequently depositing the resulting solid particulate on the shredded cellulosic fibers.

5. A method in accordance with claim 4 wherein said mixture is obtained by blending a particulate fire retardant agent with a particulate anti-static agent.

6. A method in accordance with claim 4 wherein said mixture is obtained by spraying a solution of said anti-static agent onto a particulate fire retardant agent while stirring said fire retardant agent.

7. A method in accordance with claim 6 wherein said anti-static agent is added in substantially an amount of substantially in the range of 0.02% to 0.2% by weight of the total mixture of said agents and said fibers.

8. A method for manufacturing cellulosic insulation comprising:

(a) shredding a cellulosic material to form a mass of cellulosic fibers;

(b) mixing and effecting the adhesion of an anti-static agent with an inorganic fire retardant agent to form a solid particulate; and (c) mixing said shredded cellulosic fibrous mass in a substantially unwetted form with said solid particulate mixture of said agents.

9. A method in accordance with claim 8 wherein said mixture of said agents is obtained by blending a particulate fire retardant agent with a particulate anti-static agent.

10. A method in accordance with claim 8 wherein said mixture of said agents is obtained by spraying a solution of said anti-static agent on a particulate fire retardant agent while stirring said fire retardant agent.

11. A method in accordance with claim 10 wherein said anti-static agent comprises a quaternary ammonium compound.

12. A method in accordance with claim 9 wherein said anti-static agent comprises a quaternary ammonium compound.

13. A method in accordance with claim 5 wherein said anti-static agent is added in substantially an amount of substantially in the range of 0.02% to 0.2% by weight of the total mixture of said agents and said fibers.

14. An insulation in accordance with claim 1 wherein said anti-static agent is selected from the group consisting of Dimethyldistearyl ammonium chloride and Dimethylditallow ammonium chloride.

15. An insulation in accordance with claim 1 wherein said anti-static agent is selected from the group consisting of Polyoxethlene tallow amine, Methyl-1-tallow amido ethyl-2-tallow imidizlinium methyl sulfate, Dialkyl ($C_{12}$–$C_{18}$) dimethyl ammonium chloride and dihydrogenated tallow dimethyl ammonium chloride.

16. An insulation in accordance with claim 1 wherein said anti-static agents is one or more anti-static agents selected from the group consisting of crossed linked polyamines containing poly ethoxy segments, Diakyldimethyl ammonium salts, Alkylbenzyldimethyl ammonium chlorides and Alkyltriethyl ammonium salts.

* * * * *